US009004278B2

(12) United States Patent
Monti

(10) Patent No.: US 9,004,278 B2
(45) Date of Patent: Apr. 14, 2015

(54) CARDBOARD CONTAINER FOR RECEIVING BOTTLES IN A VERTICAL CONFIGURATION AND A BLANK FOR OBTAINING THE CONTAINER

(71) Applicant: Marchesini Group S.p.A, Pianoro Bologna (IT)

(72) Inventor: Giuseppe Monti, Pianoro Bologna (IT)

(73) Assignee: Marchesini Group S.p.A., Pianoro, Bologna (IT)

( * ) Notice: Subject to any disclaimer, the term of this patent is extended or adjusted under 35 U.S.C. 154(b) by 53 days.

(21) Appl. No.: 14/047,711

(22) Filed: Oct. 7, 2013

(65) Prior Publication Data

US 2014/0097104 A1 Apr. 10, 2014

(30) Foreign Application Priority Data

Oct. 10, 2012 (IT) ..... BO2012A0551

(51) Int. Cl.

| | |
|---|---|
| ***B65D 65/00*** | (2006.01) |
| ***B65D 25/04*** | (2006.01) |
| ***B65D 5/48*** | (2006.01) |
| ***B65D 5/50*** | (2006.01) |

(52) U.S. Cl.

CPC ..... *B65D 5/48002* (2013.01); *B65D 5/4801* (2013.01); *B65D 5/5016* (2013.01)

(58) Field of Classification Search

CPC ..... B65D 5/3607; B65D 5/4801

USPC ..... 206/139, 170, 174, 175, 427, 431, 433, 206/435; 229/120.02, 120.08, 120.09, 229/120.14, 120.15, 120.18, 120.24, 229/120.26, 120.28, 165

See application file for complete search history.

(56) References Cited

U.S. PATENT DOCUMENTS

| | | | | |
|---|---|---|---|---|
| 2,144,774 | A * | 1/1939 | Richards et al. | 229/120.18 |
| 2,700,499 | A * | 1/1955 | Durand | 229/120.18 |
| 3,047,201 | A | 7/1962 | Kuchenbecker | |
| 3,563,449 | A * | 2/1971 | Forbes, Jr. | 229/120.18 |
| 3,624,790 | A | 11/1971 | Stout | |
| 4,458,837 | A * | 7/1984 | Sellors | 229/120.14 |
| 5,267,645 | A * | 12/1993 | Tokunaga et al. | 229/120.26 |
| 5,465,834 | A * | 11/1995 | Sieber et al. | 206/427 |
| 6,196,449 | B1 * | 3/2001 | Chen | 229/120.26 |
| 2008/0237326 | A1 | 10/2008 | Bates | |
| 2013/0153649 | A1 * | 6/2013 | Monti | 229/120.08 |

* cited by examiner

*Primary Examiner* — Luan K Bui

(74) *Attorney, Agent, or Firm* — R. Neil Sudol; Henry D. Coleman

(57) ABSTRACT

The cardboard container (100) comprises a base wall (B) and two lateral walls (L1, L2), in a single body with the base wall (B) and foldable with respect thereto, so as to enable the container (100) to assume a flat configuration (I) and an opened-out configuration (V). The container (100) further comprises at least a tab (1), in a single body with a first lateral wall (L1), at a first transversal edge (L11) thereof. The tab (1) has a shape that is such that it exhibits a series of portions (11, 12, 13, 14, 15, 16, 17) that are foldable with respect to one another, and such that two of the portions are connected to the first lateral wall (L1) at two different positions (P1, P2) such that when the container is placed in the opened-out configuration (V), the various portions of the tab (1) fold with respect to the first lateral wall (L1) and reciprocally one respect to the others in such a way as to define three seatings (S1, S2, S3) each of which has a shape that is suitable for receiving a corresponding bottle, with the bottom of each bottle going to rest on the base wall (B) and with each bottle being surrounded and protected between the respective portions of the tab (1) and the first lateral wall (L1).

15 Claims, 4 Drawing Sheets

CARDBOARD CONTAINER FOR RECEIVING BOTTLES IN A VERTICAL CONFIGURATION AND A BLANK FOR OBTAINING THE CONTAINER

FIELD OF THE INVENTION

The present invention relates to the technical sector concerning the packing of bottles, for example bottles containing pharmaceutical or cosmetic products.

DESCRIPTION OF PRIOR ART

In this specific technical sector a process usually carried out to achieve packing of bottles includes positioning the bottles, in a vertical configuration, in a relative support container, and then inserting the container, containing the bottles, internally of a box, so as to obtain the final pack.

The containers used for supporting the bottles can for example be made of a plastic material, which are obtained following a heat-forming process in such a way as to exhibit a series of vertical housings in which the bottles are positioned; for example they can include a single row of housings or even two or three flanked rows of housings, according to the type of pack which is to be obtained or even the dimensions of the bottles.

This type of container exhibits a structure that in itself is rigid, and consequently they exhibit a non-reducible volume; this circumstance can be disadvantageous in terms of space and dimensions required for the predisposing of relative stores in the machines for carrying out the packing operations in an automatic and/or semi-automatic manner.

Also known is the use of cardboard containers which are obtained starting from flat blanks which, once realized using paper technology processes, are folded about relative fold lines in such a way as to form a container.

The container obtained in this way exhibits the particularity of exhibiting a much smaller size with respect to the case of the containers made of plastic material, as it can be maintained in a flat configuration, with the aim of facilitating the storage thereof, and, at the moment of inserting the bottles, it can be brought into an opened-out configuration.

The use of cardboard containers without doubt exhibits the advantage of being able to store them in significantly smaller stores than is the case with the use thereof in containers made of a plastic material.

Usually cardboard containers of the prior art exhibit a base wall, a first lateral wall that is in a single body with the base wall, at a first longitudinal side thereof, and a second lateral wall which is fixed, for example by gluing, to the base wall at the relative second longitudinal side, and an upper wall, in a single body with the two lateral walls, which upper wall is provided with through-holes for inserting bottles in a vertical configuration.

For example, the holes can be arranged along a single row, or in two or more flanked rows.

The two lateral walls are foldable both with respect to the base wall and the upper wall in such a way as to enable the container to assume both a flat configuration that can then be brought into the opened-out use configuration.

In the flat configuration the first lateral wall is arranged externally and on the same plane as the base wall, the second lateral wall is instead arranged above and in contact with the base wall and the upper wall is arranged above and in contact with the base wall and with the first lateral wall.

The fact that the upper wall of the container is in a single body with the two lateral walls gives a certain "heaviness" to the container, when it is placed in the opened-out configuration, and the lateral walls therefore tend to flex.

Further, the upper wall must exhibit dimensions that are such that the through-holes are not too near to one another nor to the lateral walls, which would weaken it and would not allow positioning the bottles in the holes present therein with sufficient stability.

Consequently the dimensions of the upper wall, and thus also those of the base wall, are designed such that there is a certain space both between the holes and also a certain space between the holes and the lateral walls, such as to counter undesired flexions and/or folding of the parts of the upper wall about the holes when they are inserted in the bottles.

This, however, inevitably leads to the realising of cardboard containers which exhibit dimensions both in a transversal direction and in the longitudinal direction that are greater than those of containers made of a plastic material.

Consequently, and disadvantageously, there will be the need to change the dimensions of the boxes in the case where it is desired to pack the bottles using a support container made of cardboard instead of plastic material.

The applicant has already brilliantly obviated the above-mentioned problems with a new cardboard container and a relative blank which were the object of a corresponding patent application no. BO2011A000736 filed on Dec. 20, 2011.

The container described in the previous application was particularly advantageous when the bottles were two or four in number, arranged in two rows each containing two containers.

The container of the previous application was conceived also to receive more than four bottles, for example ten bottles, arranged in two rows having five bottles.

In this case, the conformation of the container was such that when opened-out, ten seatings were defined, i.e. two rows of five seatings, for receiving corresponding ten bottles.

However the conformation of the container was such that the central seating of each of the two rows of seatings (i.e. the third seating of each row) was not completely surrounded by relative portions of the container and therefore the bottle inserted therein was directly facing the corresponding bottle inserted in the central seating of the other row, without the interposing of any separating or dividing wall.

With this particular conformation of the container, suitable for containing up to ten bottles, it is therefore not possible to exclude with certainty the possible outcome that during transport or handling of the final pack, the two bottles might go into direct contact, and thus might be subject to reciprocal impacts which could be potentially dangerous for the integrity thereof.

SUMMARY OF THE INVENTION

The aim of the present invention is therefore to provide a new cardboard container for receiving bottles in a vertical configuration, and a new blank usable for obtaining, following folding thereof, the container; the new container constituting a further improvement of the container already described in the preceding patent application, i.e. able to preserve the integrity of all the bottles predisposed therein, independent of the number thereof, and at the same time obviating the drawbacks present in the plastic or cardboard containers of the prior art cited in the preceding.

In particular, therefore, an aim of the present invention is to provide a new cardboard container for receiving bottles in a vertical configuration which can assume a flat configuration and which, once opened-out so as to receive the bottles, exhibits modest dimensions in both a transversal and a longitudinal direction, i.e. transversal and longitudinal dimensions that are smaller than those of the cardboard containers of the prior art and comparable to those of the containers in plastic material and which, independently of the number of bottles, is such as to protect each of the bottles from any direct contacts with other bottles.

The aims are entirely obtained in accordance with the contents of claim 1.

Other special characteristics of the cardboard container disclosed in the present invention are set down in the various claims that are dependent on claim 1.

A further aim of the invention is to provide a new blank, as set down in claim 11, and in the claims depending on claim 11, which enables obtaining, once folded, the container of claims from 1 to 10.

BRIEF DESCRIPTION OF THE DRAWINGS

The characteristics of the invention will emerge from the following description of a preferred but not exclusive embodiment of a cardboard container for receiving bottles in a vertical configuration and a blank from which the container is obtained, made with reference to the accompanying tables of drawings, in which.

DESCRIPTION OF THE PREFERRED EMBODIMENTS

With reference to the figures, 100 denotes the cardboard container for receiving bottles in a vertical configuration, and (F) denotes the blank, usable following the relative folding, the container (100), disclosed in the present invention.

Figure 2:
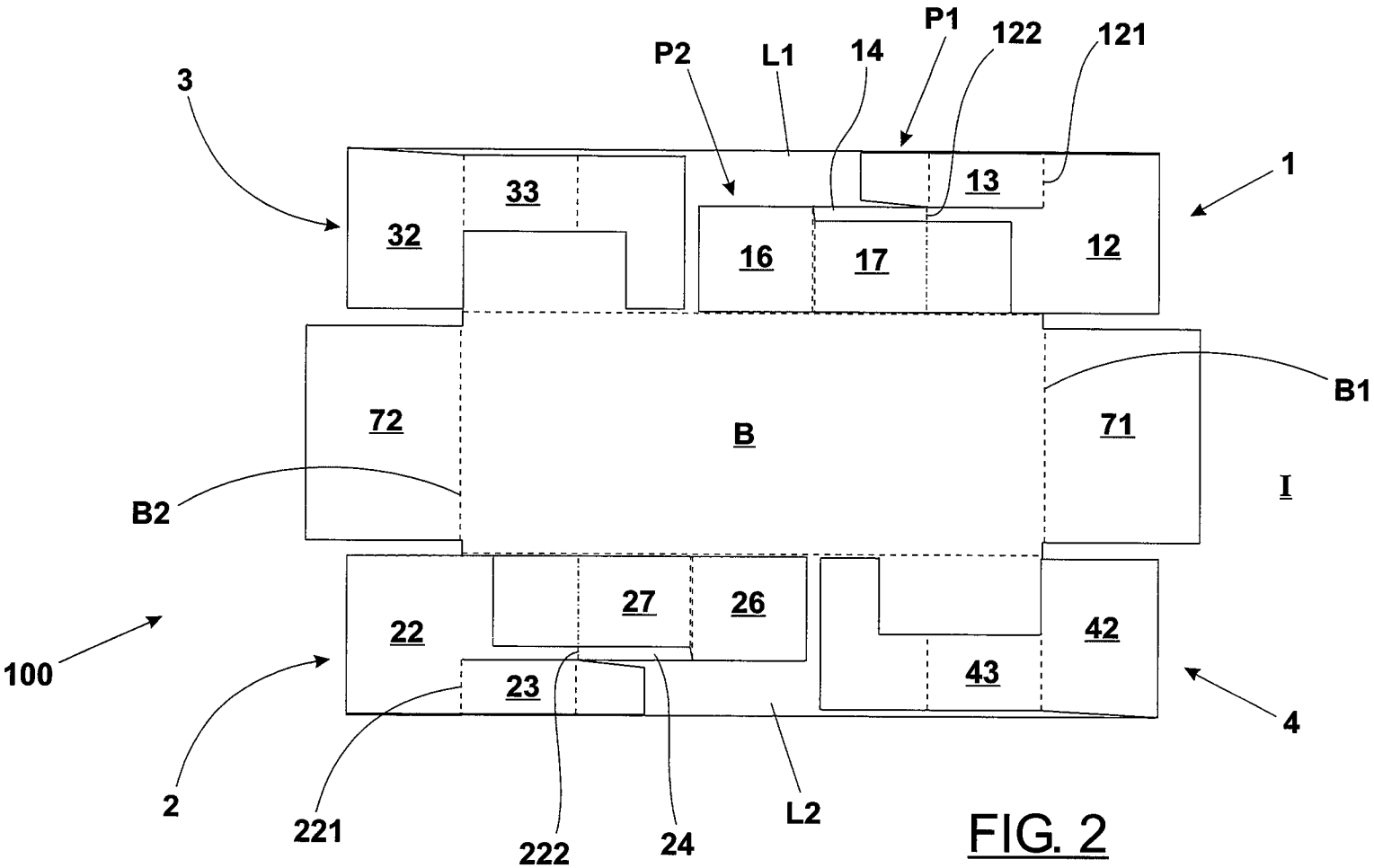
FIG. 2 illustrates, in a view from above, the cardboard container of the invention in the flat configuration, for storing in a store (not illustrated) comprised in automatic and semi-automatic packing machines.
Figure 4:
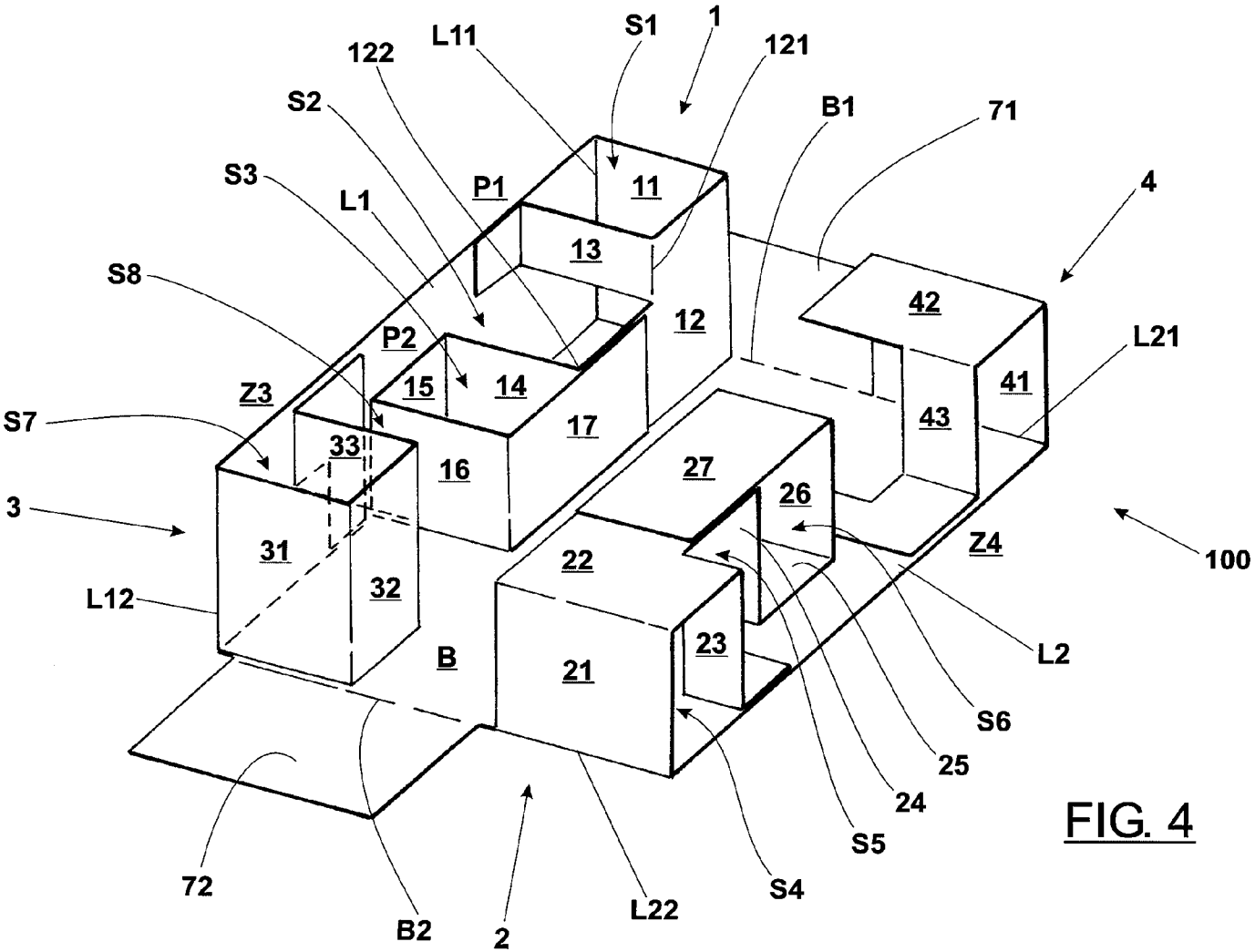
FIG. 4 illustrates, in a perspective view, the cardboard container of the invention in a step of passage from a flat configuration, as in FIG. 2, to the opened-out configuration, as in FIG. 1.

The cardboard container (100) comprises, as is for example clearly visible in FIGS. 2 and 4, a base wall (B) and two lateral walls (L1, L2) which are in a single body with the base wall (B) with a relative longitudinal side respectively at two opposite longitudinal sides of the base wall (B).

Figure 1:
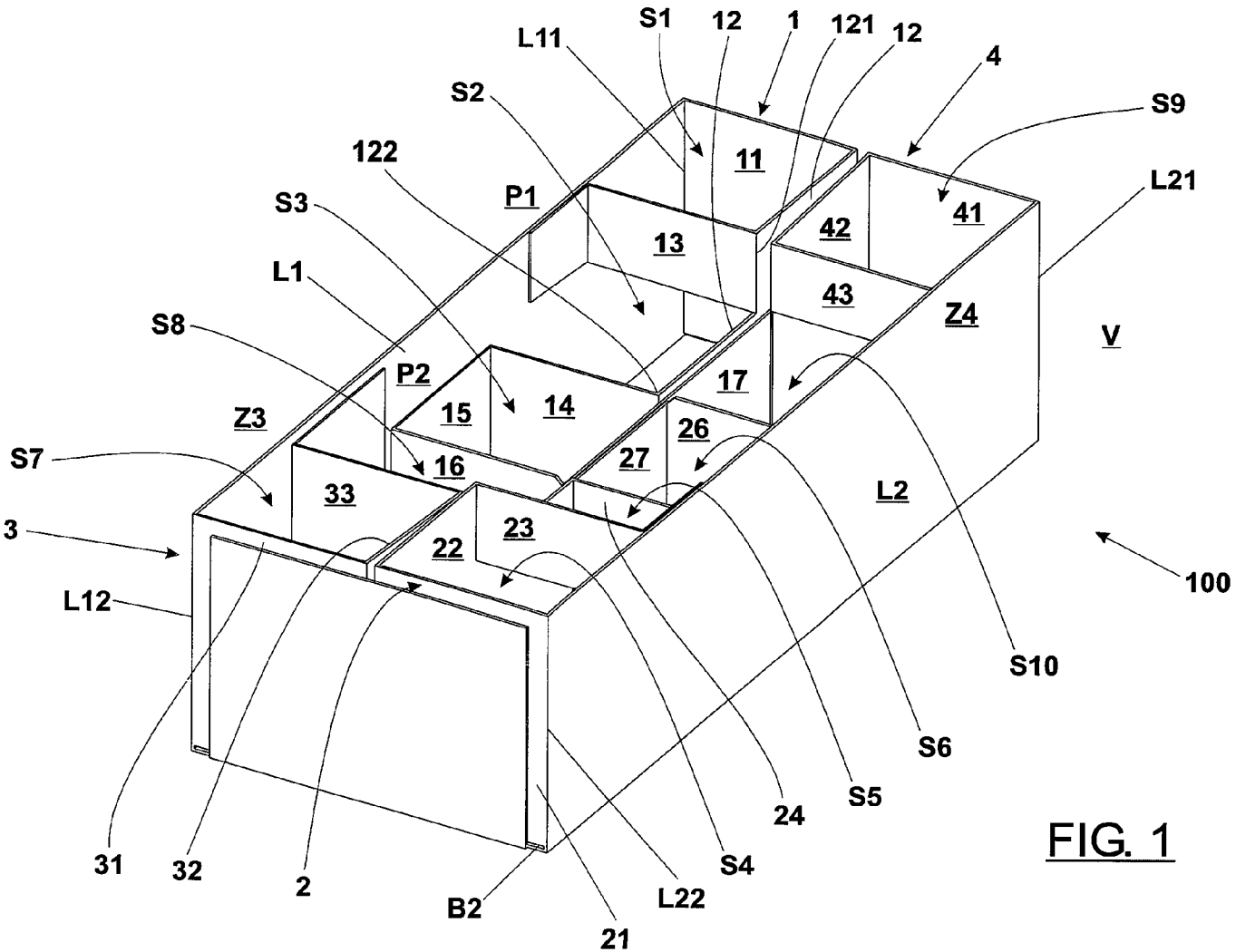
FIG. 1 is a perspective view of the cardboard container for receiving bottles in a vertical configuration of the invention, in the opened-out configuration thereof ready for receiving the bottles.

The two lateral walls (L1, L2) are foldable with respect to the base wall (B) (see for example FIG. 4 where a folding step of the lateral walls (L1, L2) with respect to the base wall (B) is illustrated) such as to enable the container (100) to take on a flattened configuration (I) (illustrated in FIG. 2) and an opened-out configuration (V) (illustrated in FIG. 1).

A first peculiarity which distinguishes the container (100) of the present invention with respect to the cardboard containers of the prior art cited herein above relates to the fact that it comprises at least a tab (1), in a single body with a first lateral wall (L1) of the two lateral walls (L1, L2) at a first transversal edge (L11) thereof adjacent to a first transversal side (B1) of the base wall (B), which tab (1) exhibits a peculiar shape which enables it to be folded in a particular way with respect to the first lateral wall (L1) in such a way as to be able to obtain three seatings for inserting respective three containers, with each of the three seatings being conformed in such a way as to completely surround the bottle with relative portions of the tab.

In detail, the shape of the tab (1) is such that it exhibits, starting from the first transversal edge (L11) of the first lateral wall (L1):

a first portion (11) which is foldable with respect to the first transversal edge (L11), a second portion (12), which is foldable with respect to the first portion (11) and which is of such a shape as to exhibit a first side (121) and a second side (122) which are at a different distance from the first portion (11), a third portion (13), which is foldable with respect to the first side (121) of the second portion (12) and which is connected to the first lateral wall (L1) in a first position (P1) with respect to the first transversal edge (L11) in such a way as to be foldable also with respect to the first lateral wall (L1), a fourth portion (14) and a fifth portion (15), the fifth portion (15) being connected to the first lateral wall (L1) in a second position (P2) with respect to the first transversal edge (L11) and with the fourth portion (14) being foldable with respect both to the second side (122) of the second portion (12) and with respect to the fifth portion (15), and therefore foldable also with respect to the first lateral wall (L1)

a sixth portion (16) and a seventh portion (17), with the sixth portion (16) being foldable with respect to the fifth portion (15) and with the seventh portion (17) that is foldable with respect to the sixth portion (16) and which exhibits dimensions such as to be connected to a part of the second portion (12), in a position between the first side (121) and a second side (122) of the second portion (12).

Further, another peculiarity of the container (100) of the invention consists in the fact that:

the two lateral walls (L1, L2) are foldable with respect to the base wall (B) in such a way as to be able to arranged on a same plane containing the base wall (B), externally of the two opposite longitudinal sides of the base wall (B) (see FIG. 2), and the tab (1) is foldable in such a way that the first portion (11) thereof becomes arranged by a flank of the first lateral wall (L1) and on the same plane as the first lateral wall (L1) and that the relative second portion (12), third portion (13) and fourth portion (14) assume a flat configuration and are arranged aligned to the fifth portion (15) on a same common plane also containing the fifth portion (15) and located above the plane containing the first lateral wall (L1) and the first portion (11), and that also the sixth portion (16) and the seventh portion (17) assume a flat configuration respectively above the fifth (15) and fourth (14) portion and are arranged on a same common plane above the plane containing the fifth (15) and fourth (14) portion, in such a way that the container (100) can assume the flattened configuration (I) (in FIG. 2 the first portion (11) of the tab (1) is not visible as it is situated below the second portion (12), as also the fifth portion (15) is not visible as it is located below the sixth portion (16)).

A further specific peculiarity of the container (100) relates to the fact that:

the two lateral walls (L1, L2) are further foldable with respect to the base wall (B) in such a way as to be arrangeable opposite one another and in such a way as to form an angle with respect to the base wall (B), for example 90° (see for example first FIG. 4, wherein the first lateral wall (L1) has already been folded by 90° with respect to the base wall (B) and then FIG. 1 in which the two lateral walls (L1, L2) are opposite one another and arranged at 90° with respect to the base wall (B))

and the tab (1) is foldable with respect to the first lateral wall (L1) in such a way that the second portion (12) and the relative seventh portion (17), which is connected to the second portion (12) between the first side (121) and second side (122) thereof, are arranged between the two lateral walls (L1, L2) and in an opposite and parallel configuration to the first lateral wall (L1), while the first portion (11) and the third portion (13) are arranged with an angled configuration with respect to both the first lateral wall (L1) and the second portion (12), and that the fourth portion (14) and the sixth portion (16) are in turn in an angled configuration with respect to both the fifth portion (15), connected to the first lateral wall (L1), and, respectively, the second (12) and seventh portion (17).

In this way, thanks to the particular conformation of the tab (1), with the relative portions and folding modalities thereof, when the container (100) is placed in the opened-out configuration (V) of FIG. 1 the following will result: the first portion (11), the second portion (12), up to the relative first side (121), and the third portion (13) surround between them and the first lateral wall (L1) a first seating (S1) having a shape suitable for receiving a corresponding bottle;

the third portion (13), the second portion (12), between the relative first side (121) and second side (122), and the fourth portion (14) surround, between them and the first lateral wall (L1), a second seating (S2) having a shape suitable for receiving a corresponding bottle;

and the fourth portion (14), the fifth portion (15), the sixth portion (16) and the seventh portion (17) surround between them a third seating (S3) having a suitable shape for receiving a corresponding bottle;

in such a way that the container (100) can receive corresponding bottles in a vertical configuration in each of the seatings (S1), (S2), (S3), with the bottom of each bottle going to rest on the base wall (B) and each bottle being surrounded and protected between the relative portions of the tab (1) and the first lateral wall (L1).

Thanks to these particular modalities of folding of the two lateral walls (L1, L2), and the particular conformation of the tab (1) constituted by the series of portions, and by the modalities with which the portions are foldable, the container (100) can thus assume the opened-out configuration (V) and receive a corresponding bottle in a vertical configuration in each of the seatings (S2, S2, S3) with the bottom of the bottle which goes to rest on the base wall (B) and with each of the bottles being surrounded and protected between relative folded portions of tab (1) and the first lateral wall (L1).

In this way, the cardboard container (100) of the present invention, differently to cardboard containers of the prior art, does not include the presence of any upper wall in a single body with the two lateral walls, but, on the other hand, the advantageous presence of the tab (1), in a single body with a first transversal edge of a first lateral wall (L1).

By virtue of the special shape of the tab (1) (constituted by the series of portions, first (11), second (12), third (13), fourth (14), fifth (15), sixth (16) and seventh (17), foldable reciprocally to one another and connectable to the first lateral wall as described above in detail), when the two lateral walls (L1, L2) are folded with respect to the base wall, so as to be arranged opposite one another, the tab (1) can be folded in the above-described way and create, among the relative portions reciprocally folded and the first lateral wall, the seatings (S1, S2, S3) for receiving the bottles.

The profile of the seatings (S1, S2, S3) is therefore defined by only the thickness of the first lateral wall (L1) and by the thickness of the tab (1), i.e. by the thickness of the cardboard of which the container is constituted, consequently the dimensions of the base wall (B) can be predisposed such that the transversal and longitudinal dimensions of the container (100) in the opened-out configuration (V) are contained, comparable to the same dimensions of the containers made of heat-formed plastic material, and therefore smaller than the cardboard containers at present used in the prior art and mentioned in the foregoing.

The container (100) also retains the advantage of the cardboard containers obtained from a relative blank, i.e. the advantage of assuming a flattened configuration and thus having a height dimension that is particularly small and minimal such as to be able to be stored in stores of modest dimensions and smaller than when using plastic containers.

Further, in a particularly important aspect, the container (100) once opened out (V) exhibits the seatings (S1, S2, S3) for receiving bottles delimited by relative separating containing walls (i.e. the seatings are surrounded by the folded portions of the tab (1) and by the first lateral wall) so that the bottles inserted in the seatings are protected and preserved from possible contacts and direct impacts with other bottles.

The folding of the two lateral walls (L1, L2) with respect to the base wall (B), and the folding of the tab (1), with respect to the first lateral wall (L1), once the container (100) is extracted in a flat configuration (I) from the relative store, can be carried out without any problem by resorting to the use of folding means which are commonly used in the sector of automatic and/or semi-automatic packing apparatus.

The dimensions of the tab (1), i.e. the dimensions of the various portions that make it up, and the positions (P1, P2) at which the third portion (13) and the fifth portion (15) are respectively connected to the first lateral wall (L1), are predisposed and designed on the basis of the effective transversal dimensions of the bottles which must be packed.

In particular:

the third portion (13) will have to be connected to the first lateral wall (L1) in a first position (P1) which is distanced from the first transversal edge (L11) of the first lateral wall (L1) of a distance that is at least equal to the transversal dimension of a bottle, so that when it and the first portion (11) are folded to an angle with respect to the first lateral wall (L1) so as to define the first seating (S1), between them there is a space that is sufficient to accommodate a bottle, with the length of the first portion (11) and the third portion (13) which must be at least equal to the transversal dimensions of the bottle;

the length of the second portion (12) will be at least equal to the sum of the transversal dimensions of two bottles so that the fifth portion (15) can be connected to the first lateral wall (L1) in a second position (P2) which is distanced from the first position (P1), of connection of the third portion (13) to the first lateral wall, by a distance that is at least equal to the transversal dimensions of a bottle, so that when the third portion (13) and the fourth portion (14) are folded at an angle with respect to the first lateral wall (L1), so as to define the second seating (S2), between which there is sufficient space for accommodating a bottle, the length of the fifth portion (15) must be at least equal to the transversal dimensions of a bottle, so that when the fourth portion (14) and the sixth portion (16) are folded at an angle with respect to the fifth portion (15), so as to define the third seating (S3), between them there is a sufficient space for accommodating a bottle, the length of the seventh portion (17) must be such that once folded with respect to the sixth portion (16) it can be connected to the second portion (12).

The cardboard container (100) of the present invention, also on the basis of the number of bottles which are to be packed (for example 6 bottles, or 10 bottles as illustrated in the particular embodiment represented in the figures, or even 12 bottles) or the shape of the boxes, can also include other tabs as well as the tab (1).

For example, the container (100) can comprise a second tab (2), in a single body with the second lateral wall (L2) of the two lateral walls (L1, L2), at a transversal edge (L21, L22) thereof.

In this case the second tab (2) exhibits an identical shape to, and exhibits a series of portions (21, 22, 23, 24, 25, 26, 27) that are identical to and foldable like the tab (1), in such a way that the second tab (2) can be foldable with respect to and connectable to the second lateral wall (L2) in the same way as the tab (1) with respect to the first lateral wall (L1).

Thus:

when the two lateral walls (L1, L2) are folded with respect to the base wall (B) such as to be arrangeable on a same plane containing the base wall (B), externally of the two opposite longitudinal sides of the base wall (B), such as to place the container (100) in the flattened configuration (1), the second tab (2) is foldable such as to assume a flat configuration and be arranged on a same common plane above the second lateral wall (L2), and when the two lateral walls (L1, L2) are folded with respect to the base wall (B) in such a way as to be arrangeable opposite one another and in such a way as to form an angle with respect to the base wall (B), such as to place the container (100) in the opened-out configuration (V), is foldable with respect to the second lateral wall (L2) such as to identify, with the relative folded portions (21, 22, 23, 24, 25, 26, 27), three respective other seatings (S4, S5, S6) having a suitable shape for receiving corresponding bottles in a vertical configuration, with the bottom of each bottle going to rest on the base wall (B) and with each bottle being surrounded and protected between respective portions (21, 22, 23, 24, 25, 26, 27) of the second tab (2) and the second lateral wall (L2).

In the preferred but not exclusive embodiment of the container (100) of the invention, illustrated in the accompanying figures, the second tab (2) is in a single body with the second lateral wall (L2) of the two lateral walls (L2), at a transversal edge (L22) thereof which is adjacent to the second transversal side (B2) of the base wall (B), and the base wall (B) exhibits dimensions such that the container (100) also comprises a third tab (3), in a single body with the first lateral wall (L1) at the second transversal edge (L12) thereof, which is adjacent to the second transversal side (B2) of the base wall (B), and a fourth tab (4), in a single body with the second lateral wall (L2) at the transversal edge (L21) thereof which is adjacent to the first transversal side (B1) of the base wall (B).

In this case, the container (100) is conceived in such a way that the third tab (3) and the fourth tab (4) are of such a shape as to be foldable respectively with respect to the first lateral wall (L1) and the second lateral wall (L2) such that, when the two lateral walls (L1, L2) are folded with respect to the base wall (B) such as to be arrangeable on a same plane containing the base wall (B), externally of the two opposite longitudinal sides of the base wall (B), such as to place the container (100) in the flattened configuration (I), the third tab (3) is foldable such as to assume a flattened configuration and to be arranged above the first lateral wall (L1) and the third tab (3) is foldable in such a way as to assume a flattened configuration and to be arranged above the second lateral wall (L2) (see FIG. 2 in detail).

At the same time the container (100) is conceived such that when the two lateral walls (L2, L2) are folded with respect to the base wall (B) in such a way as to be arrangeable reciprocally opposite and in such a way as to form an angle with respect to the base wall (B), such as to place the container (100) in the opened-out configuration (V), the third tab (3) is foldable with respect to the first lateral wall (L1) such as to identify and surround between relative folded portions at least a seating (S7, S8) having a suitable shape for receiving a corresponding bottle in a vertical configuration, and the fourth tab (4) is foldable with respect to the second lateral wall (L2) in such a way as to identify and surround between relative folded portions at least a seating (S9, S10) having a shape that is suitable for receiving a corresponding bottle in a vertical configuration (see FIG. 1 in detail).

Specifically, the third tab (3) is such as to exhibit, starting from the second transversal edge (L12) of the first lateral wall (L1), a first portion (31) which is foldable with respect to the second transversal edge (L12), a second portion (32) which is foldable with respect to the first portion (31), and a third portion (33) which is foldable with respect to the second portion (32) and which is connected to the first lateral wall (L1) such as to be foldable with respect thereto.

In this way the third tab (3), the third tab (3), when the two lateral walls (L1, L2) are folded with respect to the base wall (B) in such a way as to be arrangeable on a same plane containing the base wall (B), externally of the two opposite longitudinal sides of the base wall (B), such as to place the container (100) in the flattened configuration (I), is foldable such that the relative first portion (31) is arranged by a side of the first lateral wall (L1) and on the same plane as the first lateral wall (L1), and that the relative second portion (32) and third portion (33) assume a flat configuration and are arranged on a same common plane above the first lateral wall (L1) and the first portion (31) (see FIG. 2, where however the first portion (31) is not visible as it is located below the second portion (32)).

At the same time, the third tab (3), when the two lateral walls (L1, L2) are folded with respect to the base wall (B) in such a way as to be arrangeable opposite one another and in such a way as to form an angle with respect to the base wall (B), in order to place the container (100) in the opened-out configuration (V), is foldable with respect to the first lateral wall (L1) in such a way that the relative second portion (32) is arranged between the two lateral walls (L1, L2) and opposite and parallel to the first lateral wall (L1), and in such a way that the first portion (31) and the third portion (33) are arranged at an angle with respect both to the first lateral wall (L1) and the second portion (32) such as to surround between them and the first lateral wall (L1), a seating (S7) having a suitable shape for receiving a corresponding bottle, with the bottom of the bottle going to rest on the base wall (B) and which is surrounded and protected between the first (31), second (32) and third portions (33) of the third tab (3) and the first lateral wall (L1).

Further, the base (B) and the two lateral walls (L1, L2) of the container (100) exhibit dimensions that are such that the third portion (33) of the third tab (3) is connected to the first lateral wall (L1) in a position (Z3) such that, when the container (100) is placed in the opened-out configuration (V) and the third portion (33) is folded at an angle with respect to the first lateral wall (L1), the third portion (33) is opposite and parallel to the sixth portion (16) of the first tab (1), also folded at an angle with respect to the first lateral wall (L1), and at a distance from the sixth portion (16) such as to define, between them and the lateral wall (L1), a seating (S8) having suitable dimensions for inserting a corresponding bottle in a vertical configuration.

The seating (S8) is delimited and surrounded, on the opposite side with respect to the first lateral wall (L1), by at least a portion (22, 27) of the second tab (2), once the second tab (2)

has been folded with respect to the second lateral wall (L2) such as to place the container in the opened-out configuration (V).

The third portion (33) of the third tab (3) is advantageously narrower than the second portion (32) and the first portion (31), so as to facilitate the folding of the tab (3) in the passage of the container (100) from the flat configuration (I) to the opened-out configuration (V).

The fourth tab (4), in turn, is such as to exhibit, starting from the transversal edge (L21) of the second lateral wall (L2) adjacent to the first transversal side (B1) of the base wall (B), a first portion (41), which is foldable with respect to the first transversal edge (L21), a second portion (42), which is foldable with respect to the first portion (41), and a third portion (43) which is foldable with respect to the second portion (42) and which is connected to the second lateral wall (L2) so as to be foldable with respect thereto.

In this way, when the two lateral walls (L1, L2) are folded with respect to the base wall (B) such as to be arrangeable on a same plane containing the base wall (B), externally of the two opposite longitudinal sides of the base wall (B), such as to place the container (100) in the flattened configuration (I), the fourth tab (4) is foldable such that the relative first portion (41) is arranged by a flank of the second lateral wall (L2) and on the same plane as the second lateral wall (L2), and that the second portion (42) and third portion (43) assume a flat configuration and are arranged on a same common plane above the second lateral wall (L2) and the first portion (41) (see FIG. 2, where the first portion (41) is not visible as located below the second portion (42)).

The fourth tab (4), when the two lateral walls (L1, L2) are folded with respect to the base wall (B) in such a way as to be arrangeable opposite one another and in such a way as to form an angle with respect to the base wall (B), such as to place the container (100) in the opened-out configuration (V), is also foldable with respect to the second lateral wall (L2) such that the relative second portion (42) is arranged between the two lateral walls (L1, L2) and opposite and parallel to the second lateral wall (L2), and in such a way that the first portion (41) and the third portion (43) are arranged at an angle both with respect to the second lateral wall (L2) and the second portion (42) such as to surround between them and the second lateral wall (L2) a seating (S9) having a shape that is suitable for receiving a corresponding bottle, with the bottom of the bottle going to rest on the base wall (B) and which is surrounded and protected between the first (41), the second (42) and third portion (43) of the fourth tab (4) and the second lateral wall (L2).

Further, the third portion (43) of the fourth tab (4) is connected to the second lateral wall (L2) in a position (Z4) that is such that, when the container (100) is placed in the opened-out configuration (V) and the third portion (43) is folded at an angle with respect to the second lateral wall (L2), the third portion (43) is opposite and parallel to a portion (26) of the second tab (2), also folded at an angle with respect to the second lateral wall (L2), and at a distance from the portion (26) folded at an angle such as to define, between them and the second lateral wall (L2) a seating (S10) having suitable dimensions for inserting a corresponding bottle in a vertical configuration.

The seating (S10) is further delimited and surrounded, on the opposite side of the second lateral wall (L2), by a part of the second portion (12) and a part of the seventh portion (17), connected to the second portion (12), of the first tab (1), once the first tab (1) has been folded with respect to the first lateral wall (L1) such as to place the container in the opened-out configuration (V).

The third portion (43) of the fourth tab (4) is advantageously narrower than the second portion (42) and the first portion (41), so as to facilitate the fourth tab (4) in the passage of the container (100) from the flat configuration (I) to the opened-out configuration (V).

Therefore the container (100), made in this way, as illustrated in the figures, has two rows of seatings, each row with five seatings, for a total of 10 seatings, so as to receive a same number of bottles in a vertical configuration, where each of the seatings is surrounded and delimited by relative separating walls, which are constituted by the various folded portions of the tab (1), of the second tab (2), the third tab (3) and the fourth tab (4), as described in detail in the foregoing.

In this way each bottle inserted in the container will be conserved and protected from any eventual direct contact or impact with another bottle inserted in the container.

In the case of the preferred embodiment of the container (100) described above and illustrated in the accompanying figures, a first row of five seatings includes three seatings (S1, S2, S3) obtained by folding the first tab (1) (with the relative seven portions) and two seatings (S7, S8) obtained thanks to the folding of the third tab (3) with the relative three portions), while a second row of five seatings includes three seatings (S4, S5, S6) obtained thanks to the folding of the second tab (2), identical to the tab (1) (with the relative seven portions), and two seatings (S9, S10) obtained thanks to the folding of the fourth tab (4) (with the relative three portions).

Lastly, the base wall (B), the tab (1), the second tab (2), the third tab (3) and the fourth tab (4) are dimensioned in such a way that once the tab (1), the second tab (2), the third tab (3) and the fourth tab (4) are folded and with the container (100) in the opened-out configuration (V), the first portion (11) of the tab (1) and the first portion (41) of the fourth tab (4) are aligned to one another in a position above the base wall (B) at the first transversal side (B1) of the base wall (B) and the second portion (12) of the tab (1), up to the relative first side (121), and the second portion (12) of the tab (1) up to the relative first side (121) and the second portion (42) of the fourth tab (4) are arranged facing and in contact with one another (as illustrated in FIG. 4).

Correspondingly, the first portion (31) of the tab (3) and a first portion (21) of the second tab (2) are aligned with one another in a position above the base wall (B) at the second transversal side (B2) of the base wall (B) and the second portion (32) of the third tab (3) and a second portion (22) of the second tab (2) are arranged facing and in contact with one another (FIG. 2).

Further, the tab (2), the second tab (2), the third tab (3) and the fourth tab (4) are also of such dimensions that the relative portions exhibit transversal dimensions not greater than the transversal dimensions of the first lateral wall (L1) and the second lateral wall (L2).

In a further possible embodiment of the container (100) of the present invention, not illustrated in the accompanying figures, the second tab (2), having an identical shape, exhibits a series of portions that are identical to and foldable like the tab (1) and can be in a single body with the edge (L21) of the second lateral wall (B) that is adjacent to the first transversal side (B1) of the base wall (B), instead of with the transversal edge (L22) adjacent to the second transversal side (B2) of the base wall (B).

In this case, when the two lateral walls (L1, L2) are folded with respect to the base wall (B) able to be arranged opposite one another and in such a way as to form an angle with respect to the base wall (B), in order to place the container (100) in the opened-out configuration (V) the second tab (2) is foldable with respect to the second lateral wall (L2) in such a way as to identify, between the relative folded portions (21, 22, 23, 24, 25, 26, 27), the above-cited three respective other seatings, the three seatings being flanked to the three seatings (S1, S2, S3) of the tab (1), in such a way as to define two rows of three seatings flanked for the opened-out container (V).

In this case, the container (100) can contain at least six bottles, flanked three by three.

In a case in which the container (100) comprises a second tab (2), identical to the first tab (1), in a single body with the edge (L21) of the second lateral wall (L2) which is adjacent to the first transversal side (B1) of the base wall (B), the container (100) can also be made in another embodiment, not illustrated, in which the base wall (B) and the two lateral walls (L1, L2) can exhibit dimensions that are such that the container can comprise: also a third tab in a single body with the second edge (L12) of the first lateral wall (L1) which is adjacent to the second transversal side (B2) of the base wall (B), the third tab exhibiting an identical shape to, and presenting a series of identical and foldable portions like, the tab (1), and further comprising a fourth tab in a single body with the edge (L22) of the second lateral wall (L2) which is adjacent to the second transversal side (B2) of the base wall (B), the fourth tab exhibiting an identical shape to and exhibiting a series of portions identical to and foldable like the second tab (2).

In this case, when the two lateral walls (L1, L2) are folded with respect to the base wall (B) in such a way as to be arrangeable on a same plane containing the base wall (B), externally to the two opposite longitudinal sides of the base wall (B), such as to place the container (100) in the flattened configuration (I), the third tab and the fourth tab are foldable in such a way as to assume a flattened configuration and to be arranged respectively above the first lateral wall (L1) and above the second lateral wall (L2).

Further, when the two lateral walls (L1, L2) are folded with respect to the base wall (B) such as to be reciprocally arrangeable one opposite to the other and such as to form an angle with respect to the base wall (B), such as to place the container (100) in the opened-out configuration (V), the third tab is foldable with respect to the first lateral wall (L1) such as to identify, between the relative folded portions, three respective further seatings consecutive and aligned to the three seatings (S1, S2, S3) formed by the folded portions of the tab (1) and of a shape that is suitable to receive corresponding bottles in a vertical configuration, with the bottom of each bottle going to rest on the base wall (B) and with each bottle being surrounded by and protected between respective folded portions of the third tab and the first lateral wall (L1).

In the same way, correspondingly, the fourth tab is foldable with respect to the second lateral wall (L2) such as to identify, between the relative folded portions, three respective other seatings consecutive and aligned to the three seatings formed by the folded portions of the second tab (2) and of a shape that is suitable for receiving corresponding bottles in a vertical configuration, with the bottom of each bottle going to rest on the base wall (B) and with each bottle being surrounded and protected by respective folded portions of the fourth tab and the second lateral wall (L2).

Consequently, a container made in this way, once placed in the opened-out configuration (V), can have 12 seatings for receiving 12 bottles, defined by two rows of 6 consecutive seatings for the container in the opened-out configuration (V).

Lastly, in all the above-described embodiments, the container (100) can comprise a first wing (71), in a single body with the first transversal side (B1) of the base wall (B), and a second wing (72) in a single body with the second transversal side (B2) of the base wall (B).

The first wing (71) and the second are foldable with respect to the base wall (B) in such a way as to be arranged externally and on the same plane as the base wall (B), with the container (100) in the flattened configuration (I), and in such a way as to be folded at an angle with respect to the base wall (B) towards the two lateral walls (L1, L2) when the container (100) is placed in the opened-out configuration (V).

Further, the two wings (71, 72) exhibit dimensions such as to be provided with gluing means and such that once folded at an angle with respect to the base wall (B) towards the two lateral walls (L1, L2), they can be glued to the folded portions of the tab (1) and/or the second (2), and/or the third (3), and/or the fourth tab (4) which are at the first transversal side (B1) and the second transversal side (B2) of the base wall (B), such as to stabilise the opened-out configuration (V) of the container (100).

Figure 3:
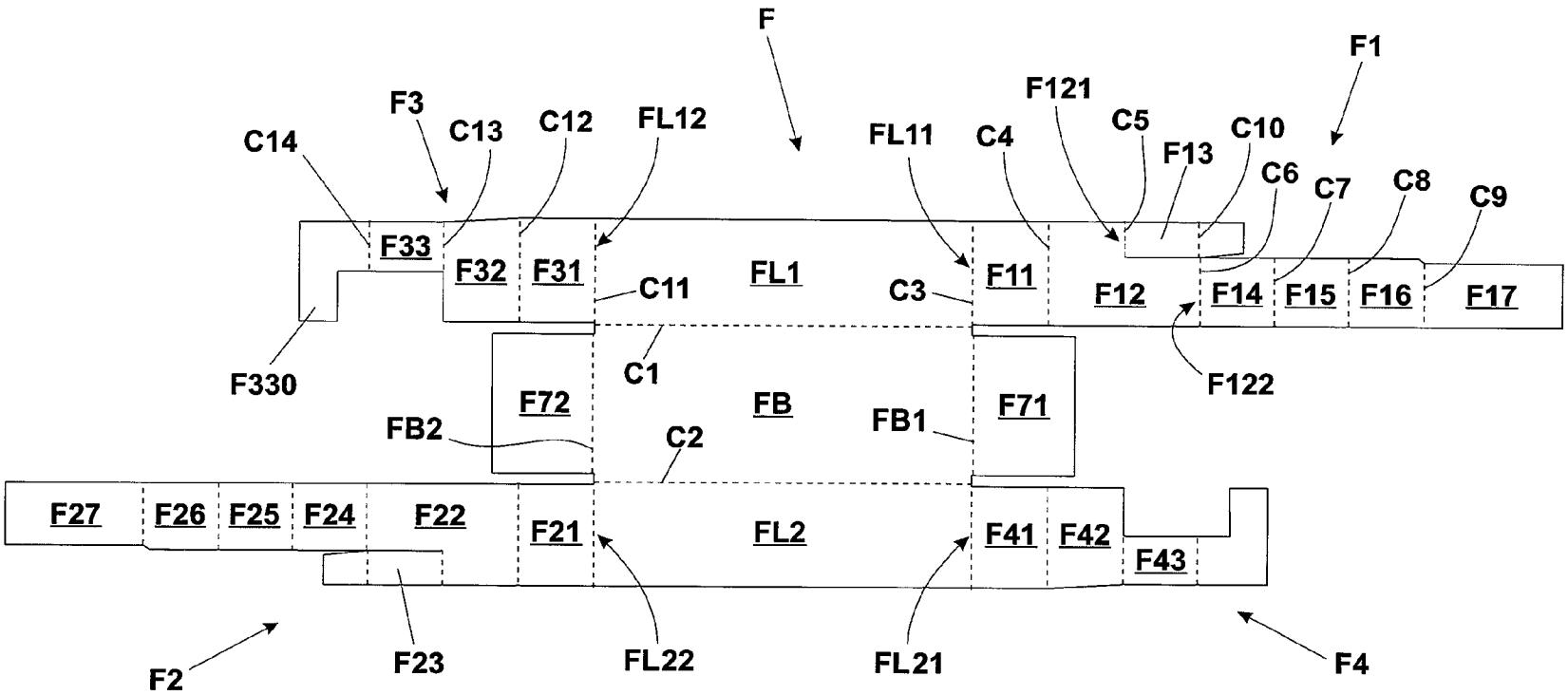
FIG. 3 illustrates, again in a view from above, the blank of the invention, from which, following folding thereof, the container of FIGS. 1-2 is obtainable.

FIG. 3 illustrates the cardboard blank (F) from which the cardboard container (100) illustrated in FIGS. 1, 2 and 4, described above, can be obtained.

The cardboard blank (F) is obtainable from a single cardboard or card sheet by means of cutting operations normally used in the paper industry.

The cardboard blank (F) is a single piece made of cardboard or card and exhibits a particular shape.

The cardboard blank (F) includes: a central section (FB), a first lateral section (FL1) and a second lateral section (FL2) arranged at opposite longitudinal sides of the central section (FB).

The central section (FB) constitutes the base wall (B) of the container, while the first lateral section (FL1) constitutes the first lateral wall (L1) and the second lateral section FL2) constitutes the second lateral wall (L2).

In this regard the cardboard blank (F) comprises: a first fold line (C1) between the central section (FB) and the first lateral section (FL1), such as to enable folding the first lateral section (FL1) with respect to the central section (FB) such that the first lateral section (FL1) can be arranged indifferently both on the same plane as the central section (FB), externally of the central section (FB), and in an angled position with respect to the central section (FB), and a second fold line (C2) between the central section (FB) and the second lateral section (FL2), such as to enable folding the second lateral section (FL2) with respect to the central section (FB) such that the second lateral section (FL2) can be arranged indifferently both on the same plane as the central section (FB), externally of the central section (FB), and in an angled position with respect to the central section (FB).

The cardboard blank (F) also comprises a tab (F1) having a shape such as to exhibit:

a first portion (F11), in a single body with a first transversal edge (FL11) of the first lateral section (FL1), a second portion (F12), consecutive to the first portion (F11), having a shape such as to exhibit a first side (F121) and a second side (F122) which are at a different distance from the first portion (F11), a third portion (F13) projecting from the first side (F121) of the second portion (F12) and a fourth portion (F14) projecting from the second side (F122) of the second portion (F12), a fifth portion (F15) consecutive to the fourth portion (14), a sixth portion (F16) consecutive to the fifth portion (F15) and a seventh portion (F17) consecutive to the sixth portion (F16).

Once folded with respect to the first transversal edge (FL11) and connected to the first lateral section (FL1), the tab (FL1) will constitute the tab (1) of the container (100).

For this purpose, the blank (F) comprises:

a third fold line (C3) at the first transversal edge (FL11), between the first portion (F11) of the tab (F1) and the first lateral section (FL1), such as to enable the first portion (F11) to be foldable with respect to the first lateral section (FL1), a fourth fold line (C4) between the first portion (F11) and the second portion (F12) of the tab (1), such as to enable the second portion (F12) to be foldable with respect to the first portion (F11), a fifth fold line (C5) at the first side (F121), between the second portion (F12) and the third portion (F13), such as to enable the third portion (F13) to be foldable with respect to the second portion (F12), a sixth fold line (C6) at the second side (F122), between the second portion (F12) and the fourth portion (F14), such as to enable the fourth portion (F14) to be foldable with respect to the second portion (F12), a seventh fold line (C7) between the fourth portion (F14) and the fifth portion (F15) such as to enable the fourth portion (F14) to be foldable with respect to the fifth portion (F15), an eighth fold line (C8) between the sixth portion (F16) and the fifth portion (F15) such as to enable the sixth portion (F16) to be foldable with respect to the fifth portion (F15), and a ninth fold line (C9) between the seventh portion (F17) and the sixth portion (F16) such as to enable the seventh portion (F17) to be foldable with respect to the sixth portion (F16).

In this way:

the second portion (F12) being predisposed to be folded with respect to the first portion (F11), about the fourth fold line (C4), such as to enable a part of the third portion (F13), once folded with respect to the first side (F121) of the second portion (F12) about the fifth fold line (C5), to be fixed to the first lateral section (FL1) at a first position (P1), the fourth portion (F14) is predisposed to be folded with respect to the second side (F122) of the second portion (F12), about the sixth fold line (C6), such as to enable the fifth portion (F15) to be fixed to the first lateral section (FL1) at a second position (P2) at a greater distance with respect to the first transversal edge (F11) of the first lateral section (FL1), while the sixth portion (16) is predisposed to be folded with respect to the fifth portion (F15), about the eighth fold line (C8), and the seventh portion (17) is predisposed to be folded with respect to the sixth portion (F16), about the ninth fold line (C9), in such a way that a part of the seventh portion (F17) can be arranged above a part of the second portion (F12) such as to be connectable thereto, The cardboard blank (F) further comprises a tenth fold line (C10) at the part of the third portion (F13) destined to be fixed to the first lateral section (FL1) in such a way as to enable the third portion (F13) to be foldable with respect to the first lateral section (FL1), once fixed thereto.

According to the number of bottles that are to be predisposed internally of a container and therefore to be packing internally of a box, the blank (F) can further comprise at least a second tab (F2) exhibiting an identical shape and being provided with a series of portions (F21, F22, F23, F24, F25, F26, F27) and relative fold lines, identical and corresponding to the tab (F1), which second tab (F2) is in a single body with the first transversal edge (FL21) of the second lateral section (FL2), which is adjacent to the first transversal side (FB1) of the central section (FB), or with the second transversal side (FL22) of the second lateral section (FL2), which is adjacent to the second transversal side (FB2) of the central section (FB), in such a way that the second tab (F2) can be folded and connected to the second lateral section (FL2) in the same way in which the tab (F1) is folded and connected to the first lateral section (FL1).

In the preferred embodiment of the blank of the invention, usable for obtaining a container able to contain ten bottles (see the relative description made above relating to a corresponding container made with reference to FIGS. 1,2 and 4), the blank (F) comprises the second tab (F2) which is in a single body with the second transversal edge (FL22) of the second lateral section (FL21).

In this case, the blank (F) is such that the central portion (FB) exhibits dimensions such that the blank (F) comprises also a third tab (F3) in a single body with the first lateral section (FL1) at the second transversal edge (FL12) thereof.

The third tab (F3) has a shape that is such as to exhibit, starting from the second transversal edge (FL12), and in a single body therewith:

a first portion (F31), a second portion (F32) consecutive to the first portion (F31) and a third portion (F33) consecutive to the second portion (F32) and, for example, narrower than the second portion (F32).

The blank (F) is also provided with:

an eleventh fold line (C11) at the second transversal edge (FL12), between the first portion (F31) of the third tab (F3) and the first lateral section (FL1), such that the first portion (F31) is foldable with respect to the first lateral section (FL1), a twelfth fold line (C12) between the first portion (F31) and the second portion (F32) of the third tab (F3), such as to enable the second portion (F32) to be foldable with respect to the first portion (F31);

a thirteenth fold line (C13) between the third portion (F33) and the second portion (F32) such as to enable the third portion (F33) to be foldable with respect to the second portion (F32), the second portion (F32) being predisposed to be folded about the twelfth fold line (C12) in such a way as to enable the third portion (F33) to be arranged above the first lateral section (FL1) and in such a way that an end part (F330) of the third portion (F33) can be connected to the first lateral section (FL1);

a fourteenth fold line (C14) at the end part of the third portion (F33) destined to be fixed to the first lateral section (FL1) such as to enable the third portion (F33) to be foldable with respect to the first lateral section (FL1), once fixed thereto.

In this preferred embodiment the blank (F) further includes a fourth tab (4) in a single body with the second lateral section (FL2) at the first transversal edge (FL21) thereof, the fourth tab (4) exhibiting an identical shape and being provided with a series of portions (F41, F42, F43) and relative identical fold lines and corresponding to the third tab (F3), in such a way that the fourth tab (F4) can be folded and connected to the second lateral section (FL2) in the same way in which the third tab (F3) is folded and connected to the first lateral section (FL1).

In a further possible embodiment, not illustrated, the blank (F) can have the second tab (F2), identical to the tab (F1), in a single body with the first lateral edge (FL21) of the second lateral section (FL2), being usable for obtaining a container for at least six bottles, with two rows of three bottles (see the relative description made herein above for a container made in this way).

When the second tab (F2) of the blank is in a single body with the first lateral edge (FL21) of the second lateral section (FL2), the blank (F) can be conceived in such a way that the relative central section (FB) has dimensions that are such that the blank (F) can also be provided with a third tab (F3) which is in a single body with the second transversal edge (FL12) of the first lateral section (FL1), and which exhibits an identical shape to the tab (F1), and which is provided with a series of identical and corresponding portions to those of the first tab (F1), such that the third tab (F3) can be folded and connected to the first lateral section (FL1) in the same way as the tab (F1).

The blank (F), in this other possible embodiment, will also be provided with a fourth tab (F4) that is in a single body with the second transversal edge (FL22) of the second lateral section (FL2), and which exhibits an identical shape to the second tab (F2) and which is provided with a series of identical portions, and relative fold lines identical and corresponding to those of the second tab (F2), in such a way that the fourth tab (F4) can be folded and connected to the second lateral section (FL2) in the same way as the second tab (F2).

In this way the blank (F) can be used to obtain a container which can receive 12 bottles, in two rows of six bottles each (see the relative description made herein above for a container made in this way).

In both embodiments described above the blank (F) is such that it further comprises a first wing (F71) at a first transversal side (FB1) of the central section (FB), and a second wing (F72) at a second transversal side (FB2) of the central section (FB), and corresponding fold lines between the first wing (F71) and the central section (FB) and between the second wing (F72) and the central section (FB), such that the first wing (F71) and the second wing (F72) are foldable with respect to the central section (FB).

The foregoing has been described purely by way of non-limiting example, and any constructional variants are understood to fall within the scope of the following claims.

The invention claimed is:

1. A cardboard container for receiving bottles in a vertical configuration, of a type comprising:

a base wall, two lateral walls which are in a single body with the base wall with a relative longitudinal side respectively at two opposite longitudinal sides of the base wall and which are foldable with respect to the base wall such as to enable the container to take on a flattened configuration and an opened-out configuration, at least a tab, in a single body with a first lateral wall of the two lateral walls at a first transversal edge thereof adjacent to a first transversal side of the base wall, the tab exhibiting, starting from the first transversal edge of the first lateral wall, a first portion which is foldable with respect to the first transversal edge, a second portion, which is foldable with respect to the first portion and which is of such a shape as to exhibit a first side and a second side which are at a different distance from the first portion, a third portion, which is foldable with respect to the first side of the second portion and which is connected to the first lateral wall in a first position with respect to the first transversal edge in such a way as to be foldable also with respect to the first lateral wall, wherein the tab is such as to exhibit also a fourth portion and a fifth portion, the fifth portion being connected to the first lateral wall in a second position with respect to the first transversal edge and with the fourth portion being foldable with respect both to the second side of the second portion and with respect to the fifth portion, and therefore foldable also with respect to the first lateral wall, and further such as to exhibit a sixth portion and a seventh portion, with the sixth portion being foldable with respect to the fifth portion and with the seventh portion that is foldable with respect to the sixth portion and which exhibits dimensions such as to be connected to a part of the second portion, in a position between the first side and a second side of the second portion, and wherein the two lateral walls are foldable with respect to the base wall such as to be arrangeable on a same plane containing the base wall, externally of the two opposite longitudinal sides of the base wall, and with the tab being foldable in such a way that the first portion thereof becomes arranged by a flank of the first lateral wall and on the same plane as the first lateral wall and that the relative second portion, third portion and fourth portion assume a flat configuration and are arranged aligned to the fifth portion on a same common plane also containing the fifth portion and located above the plane containing the first lateral wall and the first portion, and that also the sixth portion and the seventh portion assume a flat configuration respectively above the fifth and fourth portion and are arranged on a same common plane above the plane containing the fifth and fourth portion, in such a way that the container can assume the flattened configuration, and wherein the two lateral walls are further foldable with respect to the base wall in such a way as to be arrangeable opposite one another and in such a way as to form an angle with respect to the base wall, and with the tab foldable with respect to the first lateral wall in such a way that the second portion and the relative seventh portion, which is connected to the second portion between the first side and second side thereof, are arranged between the two lateral walls and in an opposite and parallel configuration to the first lateral wall, while the first portion and the third portion are arranged with an angled configuration with respect to both the first lateral wall and the second portion, and that the fourth portion and the sixth portion are in turn in an angled configuration with respect to both the fifth portion, connected to the first lateral wall, and, respectively, the second portion and seventh portion such that: the first portion, the second portion, up to the relative first side, and the third portion surround between them and the first lateral wall a first seating having a shape suitable for receiving a corresponding bottle; the third portion, the second portion, between the relative first side and second side, and the fourth portion surround between them and the first lateral wall a second seating having a shape suitable for receiving a corresponding bottle, and that the fourth portion, the fifth portion, the sixth portion and the seventh portion surround between them a third seating having a suitable shape for receiving a corresponding bottle, in such a way that the container can assume the opened-out configuration and can receive corresponding bottles in a vertical configuration in each of the seating, with the bottom of each bottle going to rest on the base wall and each bottle being surrounded and protected between the relative portions of the tab and the first lateral wall.

2. The container of claim 1, comprising at least a second tab, in a single body with a second lateral wall of the two lateral walls, at a transversal edge thereof, the second tab exhibiting an identical shape to and which exhibits a series of portions identical and foldable like the tab, such that when the two lateral walls are folded with respect to the base wall such as to be arrangeable on a same plane containing the base wall, externally of the two opposite longitudinal sides of the base wall, such as to place the container in the flattened configuration, the second tab is foldable such as to assume a flattened configuration and to be arranged above the second lateral wall, and which when the two lateral walls are folded with respect to the base wall, such as to be arrangeable opposite one another such as to form an angle with respect to the base wall, in order to place the container in the opened-out configuration, the second tab is foldable with respect to the second lateral wall in such a way as to identify, with the relative folded portions, three respective other seatings having a suitable shape for receiving corresponding bottles in a vertical configuration, with the bottom of each bottle going to rest on the base wall and with each bottle being surrounded and protected between respective portions of the second tab and the second lateral wall.

3. The container of claim 2, wherein the second tab is in a single body with the second lateral wall at the transversal edge thereof that is adjacent to the second transversal side of the base wall, wherein the base wall exhibits such dimensions that the container comprises also a third tab in a single body with the first lateral wall at the second transversal side thereof, that is adjacent to the second transversal side of the base wall, and a fourth tab in a single body with the second lateral wall at the transversal edge thereof that is adjacent to the first transversal side of the base wall, and wherein the third tab and the fourth tab are of such a shape as to be foldable respectively with respect to the first lateral wall and the second lateral wall such that, when the two lateral walls are folded with respect to the base wall such as to be arrangeable on a same plane containing the base wall , externally of the two opposite longitudinal sides of the base wall , such as to place the container in the flattened configuration, the third tab is foldable such as to assume a flattened configuration and to be arranged above the first lateral wall and the third tab is foldable in such a way as to assume a flattened configuration and to be arranged above the second lateral wall , and in such a way that, when the two lateral walls are folded with respect to the base wall in such a way as to be arrangeable reciprocally opposite and in such a way as to form an angle with respect to the base wall , such as to place the container in the opened-out configuration, the third tab is foldable with respect to the first lateral wall such as to identify and surround between relative folded portions at least a seating having a suitable shape for receiving a corresponding bottle in a vertical configuration, and the fourth tab is foldable with respect to the second lateral wall in such a way as to identify and surround between relative folded portions at least a seating having a shape that is suitable for receiving a corresponding bottle in a vertical configuration.

4. The container of claim 3, wherein the third tab is such as to exhibit, starting from the second transversal edge of the first lateral wall, a first portion which is foldable with respect to the second transversal edge, a second portion which is foldable with respect to the first portion, and a third portion which is foldable with respect to the second portion and which is connected to the first lateral wall such as to be foldable with respect thereto, such that the third tab, when the two lateral walls are folded with respect to the base wall in such a way as to be arrangeable on a same plane containing the base wall, externally of the two opposite longitudinal sides of the base wall, such as to place the container in the flattened configuration, is foldable such that the relative first portion is arranged by a side of the first lateral wall and on the same plane as the first lateral wall, and that the relative second portion and third portion assume a flat configuration and are arranged on a same common plane above the first lateral wall and the first portion, and that the third tab, when the two lateral walls are folded with respect to the base wall in such a way as to be arrangeable opposite one another and in such a way as to form an angle with respect to the base wall , in order to place the container in the opened-out configuration, is foldable with respect to the first lateral wall in such a way that the relative second portion is arranged between the two lateral walls and opposite and parallel to the first lateral wall, and in such a way that the first portion and the third portion are arranged at an angle with respect both to the first lateral wall and the second portion such as to surround between them and the first lateral wall, a seating having a suitable shape for receiving a corresponding bottle, with the bottom of the bottle going to rest on the base wall and which is surrounded and protected between the first, second and third portions of the third tab and the first lateral wall, and wherein the fourth tab is such as to exhibit, starting from the transversal edge of the second lateral wall adjacent to the first transversal side of the base wall , a first portion, which is foldable with respect to the first transversal edge, a second portion which is foldable with respect to the first portion, and a third portion which is foldable with respect to the second portion and which is connected to the second lateral wall in such a way as to be foldable with respect thereto, such that, when the two lateral walls are folded with respect to the base wall such as to be arrangeable on a same plane containing the base wall, externally of the two opposite longitudinal sides of the base wall, such as to place the container in the flattened configuration, the fourth tab is foldable such that the relative first portion is arranged by a flank of the second lateral wall and on the same plane as the second lateral wall, and that the second portion and third portion assume a flat configuration and are arranged on a same common plane above the second lateral wall and the first portion, and that the fourth tab, when the two lateral walls are folded with respect to the base wall in such a way as to be arrangeable opposite one another and in such a way as to form an angle with respect to the base wall, such as to place the container in the opened-out configuration, is foldable with respect to the second lateral wall such that the relative second portion is arranged between the two lateral walls and opposite and parallel to the second lateral wall, and in such a way that the first portion and the third portion are arranged at an angle both with respect to the second lateral wall and the second portion such as to surround between them and the second lateral wall a seating having a shape that is suitable for receiving a corresponding bottle, with the bottom of the bottle going to rest on the base wall and which is surrounded and protected between the first portion, the second portion and the third portion of the fourth tab and the second lateral wall.

5. The container of claim 4, wherein the base, and the two lateral walls exhibit dimensions such that the third portion of the third tab is connected to the first lateral wall in a position such that, when the container is placed in the opened-out configuration and the third portion is folded at an angle with respect to the first lateral wall, the third portion is opposite and parallel to the sixth portion of the first tab, also folded at an angle with respect to the first lateral wall, and at a distance from the sixth portion such as to define, between them and the lateral wall, a seating having suitable dimensions for inserting a corresponding bottle in a vertical configuration, the seating being delimited and surrounded, on the opposite side with respect to the first lateral wall, by at least a portion of the second tab, once the second tab has been folded/ with respect to the second lateral wall such as to place the container in the opened-out configuration, and wherein the base, and the two lateral walls exhibit dimensions such that the third portion of the fourth tab is connected to the second lateral wall in a position that is such that, when the container is placed in the opened-out configuration and the third portion is folded at an angle with respect to the second lateral wall, the third portion is opposite and parallel to a portion of the second tab, also folded at an angle with respect to the second lateral wall , and at a distance from the portion folded at an angle such as to define, between them and the second lateral wall a seating having suitable dimensions for inserting a corresponding bottle in a vertical configuration, the seating being delimited and surrounded, by the opposite side of the second lateral wall, by a part of the second portion and a part of the seventh portion, connected to the second portion, of the first tab, once the first tab has been folded with respect to the first lateral wall such as to place the container in the opened-out configuration.

6. The container of claim 5, wherein the base wall, the tab, the second tab, the third tab and the fourth tab are dimensioned such that, once the tab, the second tab, the third tab and the fourth tab are folded and with the container in the opened-out configuration, the first portion of the tab and the first portion of the fourth tab are reciprocally aligned in a position above the base wall at the first transversal side of the base wall and the second portion of the tab, up to the relative first side, and the second portion of the fourth tab are arranged opposite and in reciprocal contact, while the first portion of the tab and a first portion of the second tab are reciprocally aligned in a position above the base wall at the second transversal side of the base wall and the second portion of the third tab and a second portion of the second tab are arranged facing and in reciprocal contact.

7. The container of claim 2, wherein the second tab, having an identical shape to the tab and which exhibits a series of identical and folded portions like the tab, is in a single body with the edge of the second lateral wall which is adjacent to the first transversal side of the base wall, such that, when the two lateral walls are folded with respect to the base wall such as to be mutually arrangeable opposite one another such as to form an angle with respect to the base wall, such as to place the container in the opened-out configuration, the second tab is foldable with respect to the second lateral wall such as to identify, between the relative folded portions, the above said three respective other seatings, the three seatings being flanked to the three seatings of the tab, such as to define two rows of three flanked seatings for the container in the opened-out configuration.

8. The container of claim 7, wherein the base wall and the two lateral walls exhibit dimensions such that the container exhibits a third tab in a single body with the second edge of the first lateral wall which is adjacent with the second transversal side of the base wall, the third tab exhibiting an identical shape to, and exhibiting a series of identical and foldable portions like the tab, and further comprises a fourth tab in a single body with the edge of the second lateral wall which is adjacent to the second transversal side of the base wall, the fourth tab exhibiting an identical shape to and exhibiting a series of portions that are identical and foldable like the second tab in such a way that, when the two lateral walls are folded with respect to the base wall in such a way as to be arrangeable on a same plane containing the base wall, externally to the two opposite longitudinal sides of the base wall, such as to place the container in the flattened configuration, the third tab and the fourth tab are foldable in such a way as to assume a flattened configuration and to be arranged respectively above the first lateral wall and above the second lateral wall , and that when the two lateral walls are folded with respect to the base wall such as to be reciprocally arrangeable one opposite to the other and such as to form an angle with respect to the base wall, such as to place the container in the opened-out configuration, the third tab is foldable with respect to the first lateral wall such as to identify, between the relative folded portions, three respective further seatings consecutive and aligned to the three seatings formed by the folded portions of the tab and of a shape that is suitable to receive corresponding bottles in a vertical configuration, with the bottom of each bottle going to rest on the base wall and with each bottle being surrounded by and protected, between respective folded portions of the third tab and the first lateral wall, and the fourth tab is foldable with respect to the second lateral wall such as to identify, between the relative folded portions, three respective other seatings consecutive and aligned to the three seatings formed by the folded portions of the second tab and of a shape that is suitable for receiving corresponding bottles in a vertical configuration, with the bottom of each bottle going to rest on the base wall and with each bottle being surrounded and protected by respective folded portions of the fourth tab and the second lateral wall, in such a way as to define two rows of 6 consecutive seatings for the container in the opened-out configuration.

9. The container of claim 8, wherein the base wall, the tab, the second tab, the third tab and the fourth tab are dimensioned such that, once the tab, the second tab, the third tab and the fourth tab are folded, and with the container in the opened-out configuration, the first portion of the tab and a first portion of the second tab, folded with respect to the second lateral wall, are aligned to one another in a position above the base wall, at the first transversal side of the base wall and the second portion of the tab and a second portion of the second tab, folded with respect to the first portion, are arranged facing and in reciprocal contact, while a first portion of the tab, folded with respect to the first lateral wall and a first portion of the fourth tab, folded with respect to the second lateral wall, are aligned to one another in a position above the base wall at the second transversal side of the base wall, and a second portion of the third tab, folded with respect to the first portion, and a second portion of the fourth tab, folded with respect to the first portion, are arranged facing one another and in reciprocal contact.

10. The container of claim 1, further comprising a first wing, in a single body with the first transversal side of the base wall, and a second wing, in a single body with the second transversal side of the base wall, the first wing and the second wing being foldable with respect to the base wall in such a way as to be arranged externally and on the same plane as the base wall, with the container in the flattened configuration, and in such a way as to be folded at an angle with respect to the base wall towards the two lateral walls when the container is placed in the opened-out configuration, and wherein the two wings exhibit dimensions such as to be provided with gluing means and such that once folded at an angle with respect to the base wall towards the two lateral walls, they can be glued to the folded portions of the tab and/or the second, and/or the third, and/or the fourth tab which are at the first transversal side and the second transversal side of the base wall, such as to stabilize the opened-out configuration of the container.

11. A cardboard blank, usable for obtaining a cardboard container for receiving bottles in a vertical configuration according to claim 1, comprising: a central section, a first lateral section and a second lateral section arranged at opposite longitudinal sides of the central section, a first fold line between the central section and the first lateral section, such as to enable folding the first lateral section with respect to the central section such that the first lateral section can be arranged indifferently both on the same plane as the central section, externally of the central section, and in an angled position with respect to the central section, a second fold line between the central section and the second lateral section, such as to enable folding the second lateral section with respect to the central section such that the second lateral section can be arranged indifferently both on the same plane as the central section, externally of the central section, and in an angled position with respect to the central section, and wherein it comprises at least a tab exhibiting a shape such as to exhibit: a first portion, in a single body with a first transversal edge of the first lateral section, a second portion, consecutive to the first portion, having a shape such as to exhibit a first side and a second side which are at a different distance from the first portion, a third portion projecting from the first side of the second portion and a fourth portion projecting from the second side of the second portion, a fifth portion consecutive to the fourth portion, a sixth portion consecutive to the fifth portion and a seventh portion consecutive to the sixth portion, and wherein it comprises a third fold line at the first transversal edge, between the first portion of the tab and the first lateral section, such as to enable the first portion to be foldable with respect to the first lateral section, a fourth fold line between the first portion and the second portion of the tab, such as to enable the second portion to be foldable with respect to the first portion, a fifth fold line at the first side, between the second portion and the third portion, such as to enable the third portion to be foldable with respect to the second portion, a sixth fold line at the second side between the second portion and the fourth portion, such as to enable the fourth portion to be foldable with respect to the second portion, a seventh fold line between the fourth portion and the fifth portion such as to enable the fourth portion to be foldable with respect to the fifth portion, an eighth fold line between the sixth portion and the fifth portion such as to enable the sixth portion to be foldable with respect to the fifth portion and a ninth fold line between the seventh portion and the sixth portion such as to enable the seventh portion to be foldable with respect to the sixth portion, the second portion being predisposed to be folded with respect to the first portion, about the fourth fold line, such as to enable a part of the third portion, once folded with respect to the first side of the second portion about the fifth fold line, to be fixed to the first lateral section at a first position, the fourth portion being predisposed to be folded with respect to the second side of the second portion, about the sixth fold line, such as to enable the fifth portion to be fixed to the first lateral section at a second position at a greater distance with respect to the first transversal edge of the first lateral section, and the sixth portion being predisposed to be folded with respect to the fifth portion, about the eighth fold line, and the seventh portion being predisposed to be folded with respect to the sixth portion, about the ninth fold line, in such a way that a part of the seventh portion can be arranged above a part of the second portion such as to be connectable thereto, and comprising a tenth fold line at the part of the third portion destined to be fixed to the first lateral section in such a way as to enable the third portion to be foldable with respect to the first lateral section, once fixed thereto.

12. The cardboard blank of claim 11, wherein it comprises at least a second tab exhibiting an identical shape and being provided with a series of portions and relative fold lines, identical and corresponding to the tab, which second tab is in a single body with the first transversal edge of the second lateral section, which is adjacent to the first transversal side of the central section, or with the second transversal side of the second lateral section, which is adjacent to the second transversal side of the central section, in such a way that the second tab can be folded and connected to the second lateral section in the same way in which the tab is folded and connected to the first lateral section.

13. The blank of claim 12, wherein when the blank comprises the second tab in a single body with the second transversal edge of the second lateral section, the central portion exhibits dimensions such that the blank comprises also a third tab in a single body with the first lateral section at the second transversal edge thereof, the third tab having such a shape as to exhibit, starting from the second transversal edge and in a single body therewith, a first portion, a second portion consecutive to the first portion and a third portion consecutive to the second portion, and wherein it comprises an eleventh fold line at the second transversal edge, between the first portion of the third tab and the first lateral section, such that the first portion is foldable with respect to the first lateral section, a twelfth fold line between the first portion and the second portion of the third tab, such as to enable the second portion to be foldable with respect to the first portion, a thirteenth fold line between the third portion and the second portion such as to enable the third portion to be foldable with respect to the second portion, the second portion being predisposed to be folded about the twelfth fold line in such a way as to enable the third portion to be arranged above the first lateral section and in such a way that an end part of the third portion can be connected to the first lateral section, and to include a fourteenth fold line at the end part of the third portion destined to be fixed to the first lateral section such as to enable the third portion to be foldable with respect to the first lateral section, once fixed thereto.

14. The blank of claim 13, wherein it further comprises a fourth tab in a single body with the second lateral section at the first transversal edge thereof, the fourth tab exhibiting an identical shape and being provided with a series of portions and relative identical fold lines and corresponding to the third tab, in such a way that the fourth tab can be folded and connected to the second lateral section in the same way in which the third tab is folded and connected to the first lateral section.

15. The blank of claim 11, wherein it comprises a first wing at a first transversal side of the central section and a second wing at a second transversal side of the central section and wherein it comprises corresponding fold lines between the first wing and the central section and between the second wing and the central section in such a way that the first wing and the second wing are foldable with respect to the central section.

* * * * *